US011491784B2

(12) United States Patent
Yuki

(10) Patent No.: US 11,491,784 B2
(45) Date of Patent: Nov. 8, 2022

(54) IMAGE FORMING APPARATUS

(71) Applicant: KYOCERA Document Solutions Inc., Osaka (JP)

(72) Inventor: Akira Yuki, Osaka (JP)

(73) Assignee: Kyocera Document Solutions, Inc.

( * ) Notice: Subject to any disclaimer, the term of this patent is extended or adjusted under 35 U.S.C. 154(b) by 267 days.

(21) Appl. No.: 16/997,828

(22) Filed: Aug. 19, 2020

(65) Prior Publication Data

US 2021/0060934 A1 Mar. 4, 2021

(30) Foreign Application Priority Data

Aug. 27, 2019 (JP) ..... JP2019-155079

(51) Int. Cl.

*B41J 2/165* (2006.01)
*B41J 2/045* (2006.01)
*B41J 2/21* (2006.01)
*B41J 2/205* (2006.01)

(52) U.S. Cl.

CPC ..... *B41J 2/04573* (2013.01); *B41J 2/16526* (2013.01); *B41J 2/2054* (2013.01); *B41J 2/21* (2013.01); *B41J 2002/16529* (2013.01)

(58) Field of Classification Search

CPC ..... B41J 2002/16529
See application file for complete search history.

(56) References Cited

U.S. PATENT DOCUMENTS

2006/0055715 A1 3/2006 Nakahara et al.
2015/0202865 A1* 7/2015 North ..... B41J 2/04536 347/20
2021/0331478 A1* 10/2021 Qian ..... B41J 2/16526

FOREIGN PATENT DOCUMENTS

JP 2006-076247 3/2006

* cited by examiner

*Primary Examiner* — Julian D Huffman

(57) ABSTRACT

When performing on-sheet preliminary ink ejection, a control unit (a) determines a nozzle that performs the on-sheet preliminary ink ejection, (b) randomly selects on a print sheet an ejection position candidate of an ink droplet ejected from the determined nozzle, (c) determines whether the selected ejection position candidate is included by a mask area that includes a postprocessing object, (d1) if the selected ejection position candidate is not included by the mask area, sets as the selected ejection position candidate an ejection position of an ink droplet ejected from the determined nozzle, and (d2) if the selected ejection position candidate is included by the mask area, does not set as the selected ejection position candidate an ejection position of an ink droplet ejected from the determined nozzle and sets an ejection position of an ink droplet ejected from the determined nozzle outside of the mask area.

7 Claims, 6 Drawing Sheets

FIG. 6

| CONTROL TYPE | CONTROL MANNER |
|---|---|
| A | MAKING EJECTION TIMING OF THE TARGET NOZZLE EARLIER<br>AND<br>EJECTING INK OUTSIDE OF THE MASK AREA |
| B | DELAYING EJECTION TIMING OF THE TARGET NOZZLE<br>AND<br>EJECTING INK OUTSIDE OF THE MASK AREA |
| C | MEMORIZING THE NOZZLE NUMBER OF THE TARGET NOZZLE<br>AND<br>EJECTING INK ON THE NEXT PAGE FROM THE TARGET NOZZLE |

IMAGE FORMING APPARATUS

CROSS-REFERENCE TO RELATED APPLICATIONS

This application relates to and claims priority rights from Japanese Patent Application No. 2019-155079, filed on Aug. 27, 2019, the entire disclosures of which are hereby incorporated by reference herein.

BACKGROUND

1. Field of the Present Disclosure

The present disclosure relates to an image forming apparatus.

2. Description of the Related Art

An inkjet-type image forming apparatus performs on-sheet preliminary ink ejection in order to restrain a trouble such as precision deterioration of an ink droplet hitting position and/or ink density deterioration with regard to a nozzle that ejects no ink during predetermined time. The on-sheet preliminary ink ejection is preliminary ink ejection performed (a) when an image specified by a user is printed and (b) on a paper sheet on which the image is printed.

Meanwhile, in case of commercial printing, for example, other than a user image, a post processing object may be printed such as a trim mark that specifies a cutting position for a cutting process or a color patch for evaluation of color reproductivity. In such a case, when the aforementioned on-sheet preliminary ink ejection is performed, if the ink droplet is ejected on the post processing object, then the postprocessing object on a printed matter is deteriorated and therefore a postprocess (cutting with a trim mark, color reproductivity evaluation using a color patch or the like) may be performed in low precision.

SUMMARY

An image forming apparatus according to an aspect of the present disclosure includes a print engine and a control unit. The print engine is configured to eject an ink droplet from a nozzle and thereby print an image to be printed on a print sheet. The control unit is configured to control the print engine. When performing on-sheet preliminary ink ejection, the control unit (a) determines a nozzle that performs the on-sheet preliminary ink ejection, (b) randomly selects on the print sheet an ejection position candidate of an ink droplet ejected from the determined nozzle, (c) determines whether the selected ejection position candidate is included by a mask area that includes a postprocessing object, (d1) if the selected ejection position candidate is not included by the mask area, sets as the selected ejection position candidate an ejection position of an ink droplet ejected from the determined nozzle, and (d2) if the selected ejection position candidate is included by the mask area, does not set as the selected ejection position candidate an ejection position of an ink droplet ejected from the determined nozzle and sets an ejection position of an ink droplet ejected from the determined nozzle outside of the mask area.

These and other objects, features and advantages of the present disclosure will become more apparent upon reading of the following detailed description along with the accompanied drawings.

BRIEF DESCRIPTION OF THE DRAWINGS

FIG. 6 shows a diagram that explains three control types of the circumvention control in the image forming apparatus 10 shown in FIG. 1.

DETAILED DESCRIPTION

Hereinafter, an embodiment according to an aspect of the present disclosure will be explained with reference to drawings.

Figure 1:
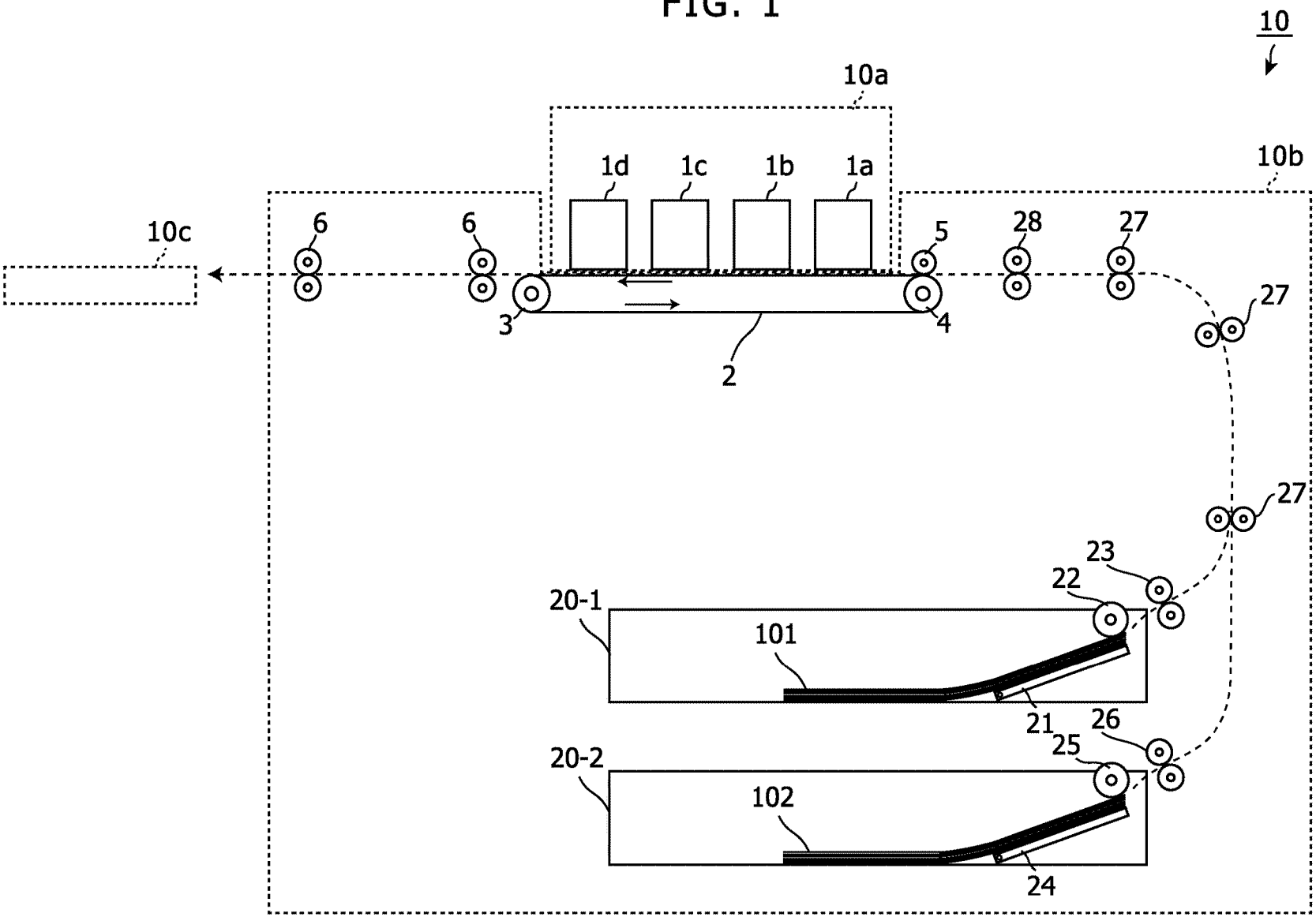
FIG. 1 shows a side view that indicates an internal mechanical configuration of an image forming apparatus in an embodiment according to the present disclosure.
Figure 2:
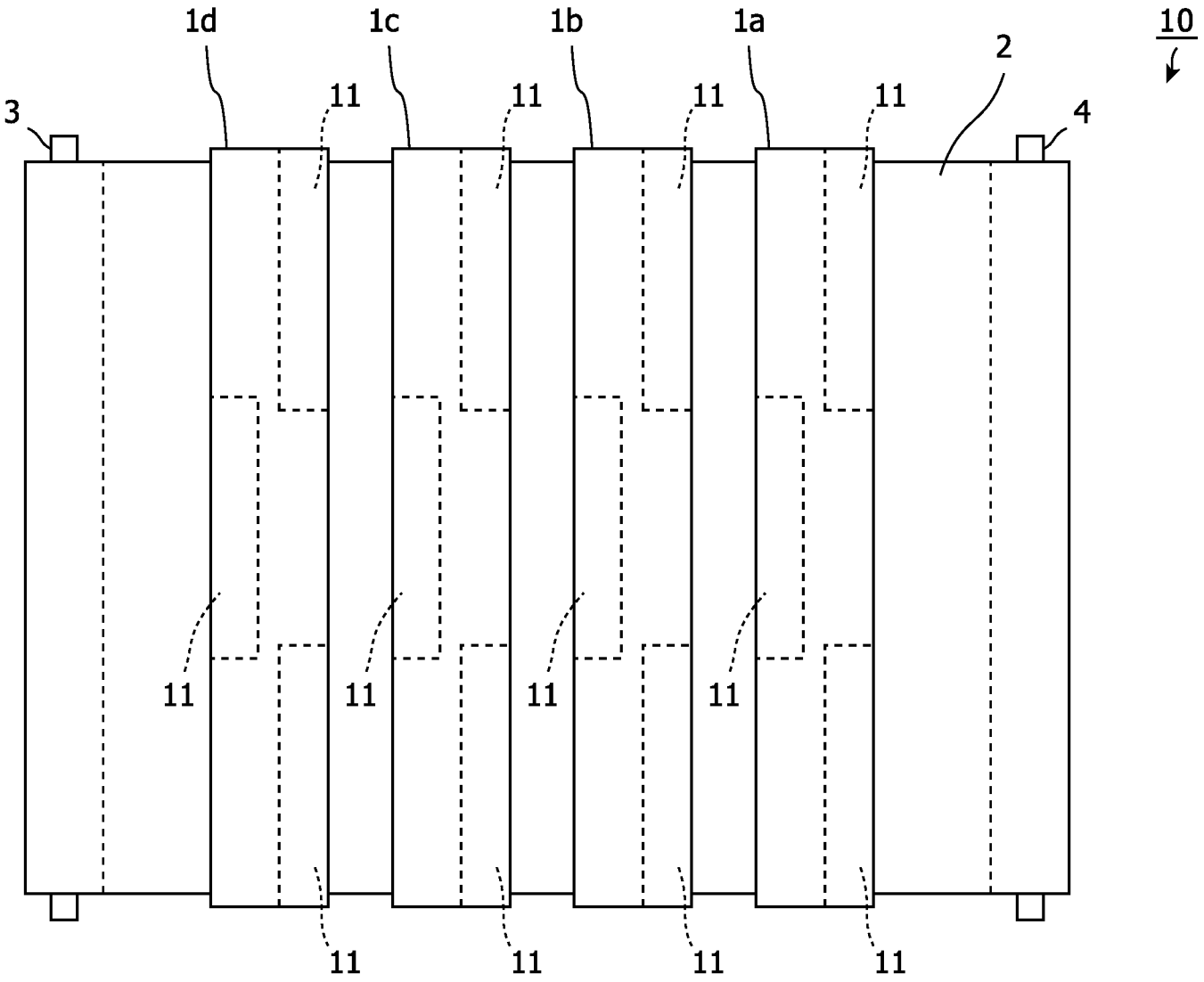
FIG. 2 shows a plane view of the image forming apparatus shown in FIG. 1.

FIG. 1 shows a side view that indicates an internal mechanical configuration of an image forming apparatus in an embodiment according to the present disclosure. FIG. 2 shows a plane view of the image forming apparatus shown in FIG. 1.

The image forming apparatus 10 in this embodiment is an apparatus such as printer, copier, facsimile machine or multi function peripheral, and includes an inkjet color printing mechanism of a line head type in this embodiment.

The image forming apparatus 10 includes a print engine 10*a* and a sheet transportation unit 10*b*. The print engine 10*a* ejects an ink droplet from a nozzle and thereby physically prints an image to be printed on a print sheet (print paper sheet or the like). The sheet transportation unit 10*b* transports the print sheet to the print engine 10*a*.

In this embodiment, the print engine 10*a* includes line-head-type inkjet recording units 1*a* to 1*d* corresponding to four ink colors: Cyan, Magenta, Yellow, and Black.

As shown in FIG. 2, in this embodiment, each inkjet recording unit 1*a*, 1*b*, 1*c* or 1*d* includes plural (here, three) head units 11. The head units 11 are arranged along a primary scanning direction, and are capable of being mounted to and demounted from a main body of the image forming apparatus. Each inkjet recording unit 1*a*, 1*b*, 1*c* or 1*d* may include only one head unit 11.

Further, in this embodiment, the sheet transportation unit 10*b* includes (a) a circular-type transportation belt 2, arranged so as to face the print engine 10*a*, that transports a print sheet, (c) a driving roller 3 and a driven roller 4 around which the transportation belt 2 is hitched, (d) a nipping roller 5 that nips the print sheet with the transportation belt 2, and (e) an output roller pair 6.

The driving roller 3 and the driven roller 4 rotate the transportation belt 2. The nipping roller 5 nips an incoming print sheet transported from a sheet feeding cassette 20-1 or 20-2 mentioned below, and the nipped print sheet is transported by the transportation belt 2 to printing positions of the inkjet recording units 1*a* to 1*d* in turn, and on the print sheet, images of respective colors are printed by the inkjet recording units 1*a* to 1*d*. Subsequently, after the printing, the print sheet is outputted by the output roller pair 6 to an output tray 10*c* or the like.

Further, the sheet transportation unit 10*b* includes plural sheet feeding cassettes 20-1 and 20-2. The sheet feeding cassettes 20-1 and 20-2 store print sheets 101 and 102, and push up the print sheets 101 and 102 using lift plates 21 and 24 so as to cause the print sheets 101 and 102 to contact with pickup rollers 22 and 25, respectively. The print sheets 101 and 102 put on the sheet feeding cassettes 20-1 and 20-2 are picked up to sheet feeding rollers 23 and 26 by the pickup rollers 22 and 25 sheet by sheet from the upper side, respectively. The sheet feeding rollers 23 and 26 are rollers that transport the print sheets 101 and 102 sheet by sheet fed by the pickup rollers 22 and 25 from the sheet feeding cassettes 20-1 and 20-2 onto a transportation path.

A transportation roller 27 is a transportation roller on the transportation path common to the print sheets 101 and 102 transported from the sheet feeding cassettes 20-1 and 20-2. The registration roller 28 temporarily stops the incoming print sheet 101 or 102 in transportation, and transports this print sheet 101 or 102 to the print engine 10*a* at a secondary sheet feeding timing. The secondary sheet feeding timing is instructed by a control unit 81 mentioned below such that an image is formed at a specified position on the print sheet 101 or 102.

For example, the sheet feeding cassettes 20-1 and 20-2 store print sheets of different types from each other.

Figure 3:
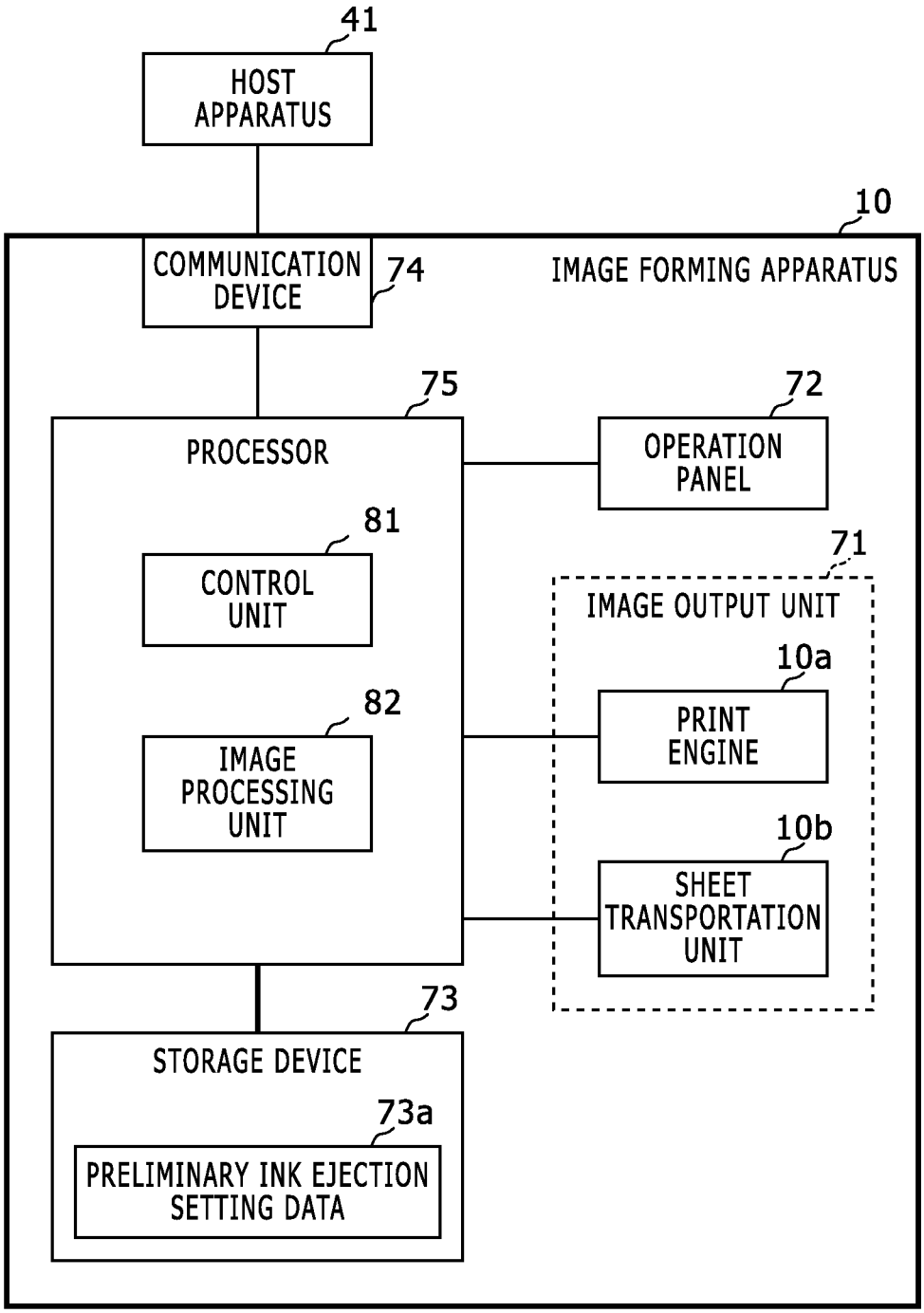
FIG. 3 shows a block diagram that indicates an electronic configuration of the image forming apparatus 10 in the embodiment according to the present disclosure.

FIG. 3 shows a block diagram that indicates an electronic configuration of the image forming apparatus 10 in the embodiment according to the present disclosure. As shown in FIG. 3, the image forming apparatus 10 includes not only an image outputting unit 71 that includes the mechanical configuration shown in FIGS. 1 and 2 but an operation panel 72, a processor 73, a communication device 74, and a processor 75.

The operation panel 72 is arranged on a housing surface of the image forming apparatus 10, and includes a display device such as a liquid crystal display and an input device such as a hard key and/or touch panel, and displays sorts of messages for a user using the display device and receives a user operation using the input device.

The storage device 73 is a non-volatile storage device (flash memory, hard disk drive or the like) in which data, a program and the like have been stored and are required for control of the image forming apparatus 10. In the storage device 73, preliminary ink ejection setting data 73*a* has been stored. The preliminary ink ejection setting data 73*a* indicates a control type of preliminary ink ejection, and this control type is set by a user.

The communication device 74 is a device that performs data communication with a host apparatus 41, and receives a print request or the like from the host apparatus 41. For example, the communication device 74 is a peripheral device interface, a network interface or the like.

The processor 75 includes a computer that acts in accordance with a program, an ASIC (Application Specific Integrated Circuit) that performs a predetermined action, and/or the like, and acts as sorts of processing units using the computer, the ASIC and/or the like. This computer includes a CPU (Central Processing Unit), a ROM (Read Only Memory), a RAM (Random Access Memory) and the like, and loads a program stored in the storage device 73, the ROM or the like to the RAM and executes the program using the CPU and thereby acts as processing units (with the ASIC if required).

Here the processor 75 acts as a control unit 81 and an image processing unit 82.

The control unit 81 controls the image outputting unit (the print engine 10*a*, the sheet transportation unit 10*b* and the like), and thereby performs a print job requested through the aforementioned print request by a user. In this embodiment, the control unit 81 causes the image processing unit 82 to perform a predetermined image process, and controls the head units 11 and causes the head units 11 to eject ink and thereby forms a printing image on a print sheet. The image processing unit 82 performs a predetermined image process such as RIP (Raster Image Processing), color conversion, halftoning and/or the like for image data of a printing image.

In particular, the control unit 81 performs on-sheet preliminary ink ejection as preliminary ink ejection of the print engine 10*a*, if necessary.

It should be noted that "preliminary ink ejection" is an action that ejects ink for a maintenance purpose rather than for an image forming purpose with a nozzle of the head units 11 that has not been used during a predetermined time or for predetermined printed pages. Further, "on-sheet preliminary ink ejection" is preliminary ink ejection performed onto a user image sheet.

Specifically, when performing on-sheet preliminary ink ejection of the print engine 10*a*, the control unit 81 (a) determines a nozzle that performs the on-sheet preliminary ink ejection, (b) randomly selects on the print sheet an ejection position candidate of an ink droplet ejected from the determined nozzle, (c) determines whether or not the selected ejection position candidate is included by a mask area that includes a postprocessing object, (d1) if the selected ejection position candidate is not included by the mask area, sets as the selected ejection position candidate an ejection position of an ink droplet ejected from the determined nozzle, and (d2) if the selected ejection position candidate is included by the mask area, does not set as the selected ejection position candidate an ejection position of an ink droplet ejected from the determined nozzle and sets an ejection position of an ink droplet ejected from the determined nozzle outside of the mask area.

The ejection position candidate of an ink droplet ejected by the determined nozzle is set as a position away from another ejection position candidate by a predetermined distance or longer (i.e. by the predetermined number of pixels or more) such that ejection position candidates are dispersed on the print sheet.

Here, the postprocessing object is a trim mark or a color patch, and there may be plural postprocessing objects that are trim marks, color patches, or a combination of them. Further, the mask area includes (a) such a postprocessing object and (b) a margin set with a predetermined width (here, a width equal to or wider than a maximum width of the ink droplet) on an outer edge of the postprocessing object. This width of the margin may be enabled to be set by a user (for example, by a user operation to the operation panel 72).

The postprocessing object is printed at a fixed position on the print sheet, and the mask area is specified by a mask image (an image with an identical size to the print image and, for example, with pixel values set as 1 in the mask area and set as 0 outside of the mask area) stored in the storage device 73; and the control unit 81 refers to the mask image and thereby determines whether or not the selected ejection position candidate (i.e. a pixel position of it) is included by the mask area that includes the postprocessing object.

Figure 4:
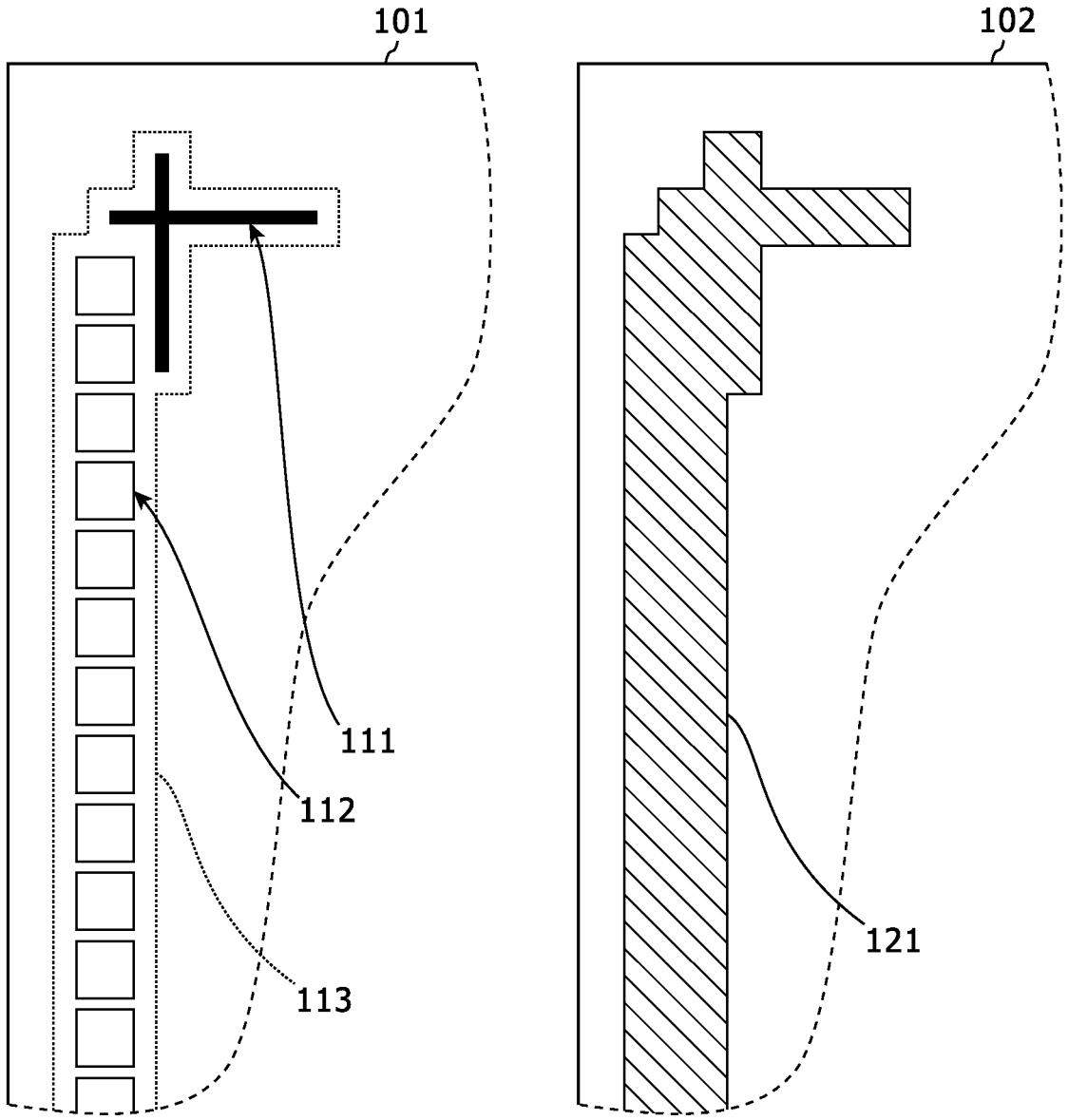
FIG. 4 shows a diagram that explains an example of a postprocessing object and a mask image used in the image forming apparatus 10 shown in FIG. 1.

FIG. 4 shows a diagram that explains an example of a postprocessing object and a mask image used in the image forming apparatus 10 shown in FIG. 1. For example, as shown in FIG. 4, a mask area 113 is set for a trim mark 111 and a color patch 112 included by the print image 101. The mask area 113 is expressed as an area 121 that has a specific pixel value in a mask image 102. The mask area 113, that is, the mask image 102 may be editable.

Further, in this embodiment, the control unit 81 performs circumvention control that causes an ejection position of an ink droplet in the on-sheet preliminary ink ejection to circumvent the postprocessing object. In the circumvention control, the control unit 81 selects one of predetermined three control types in accordance with user setting in the preliminary ink ejection setting data 73*a*, and if the selected ejection position candidate is included by the mask area, the control unit 81 performs on-sheet preliminary ink ejection of the determined nozzle in accordance with the selected control type.

Figure 5:
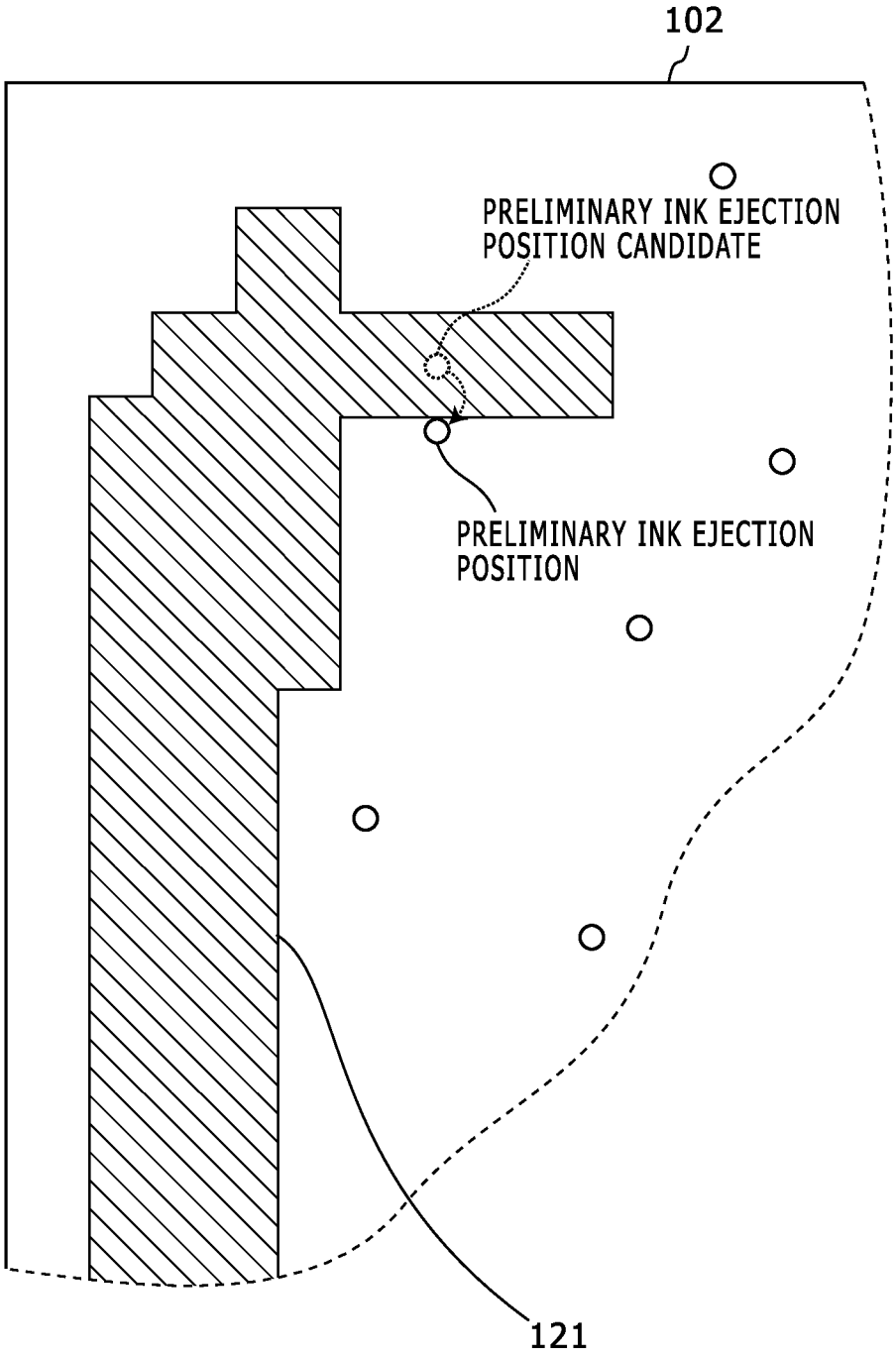
FIG. 5 shows a diagram that explains an example of circumvention control in the image forming apparatus 10 shown in FIG. 1.

FIG. 5 shows a diagram that explains an example (the control type B mentioned below) of circumvention control in the image forming apparatus 10 shown in FIG. 1. FIG. 6 shows a diagram that explains three control types of the circumvention control in the image forming apparatus 10 shown in FIG. 1. Here, as shown in FIG. 6, for example, a first control type (the control type A) among the three control types indicates a control manner that makes ejection timing of an ink droplet ejected from the determined nozzle earlier and thereby sets an ejection position of the ink droplet ejected from the determined nozzle outside of the mask area. Further, a second control type (the control type B) among the three control types indicates, as shown in FIG. 5, a control manner that delays ejection timing of an ink droplet ejected from the determined nozzle and thereby sets an ejection position of the ink droplet ejected from the determined nozzle outside of the mask area. Furthermore, a third control type (the control type C) among the three control types indicates a control manner that performs ejection of the ink droplet ejected from the determined nozzle on a subsequent print sheet to the print sheet on which the mask area is set.

Thus, in the control type A or B, the ejection timing of the ink droplet is shifted and thereby the ejection position of the ink droplet is shifted along the transportation direction (i.e. the secondary scanning direction) so as to get outside of the mask area. In the control type C, the control unit 81 memorizes in the RAM or the like a nozzle number of a nozzle that does not perform the preliminary ink ejection on a current print sheet, and in the printing of a subsequent print sheet, reads the nozzle number and performs the preliminary ink ejection of the nozzle specified by this nozzle number.

The following part explains a behavior of the image forming apparatus 10.

If the on-sheet preliminary ink ejection is performed, upon receiving a print request using the communication device 74, the control unit 81 firstly determines one or plural nozzles that should perform preliminary ink ejection on the basis of an unused period or the like, and randomly selects an ejection position candidate of an ink droplet ejected from each nozzle of the determined nozzle(s).

In this embodiment, the head unit 11 is fixed and the nozzle does not move but the print sheet moves in the transportation direction (i.e. the secondary scanning direction); and therefore, a position in the transportation direction (i.e. the secondary scanning direction) is randomly selected as the ejection position candidate. However, if the preliminary ejection for plural nozzles is performed on one print sheet, a position is selected as the ejection position candidate away from another ejection position candidate by a predetermined distance or longer (i.e. by the predetermined number of pixels or more).

Subsequently, the control unit 81 refers to the mask image based on the postprocessing object, and thereby determines whether or not the ejection position candidate of each of the determined nozzle(s) is included by the mask area.

If the ejection position candidate of the target nozzle is not included by the mask area, then the control unit 81 sets an ejection position of the target nozzle as the ejection position candidate.

If the ejection position candidate of the target nozzle is included by the mask area, then the control unit sets an ejection position outside of the mask area, corresponding to the ejection position candidate of the target nozzle.

Here, for example, in case of the control type A, the ejection position is set as a position prior to the ejection position candidate along the secondary scanning direction and outside of the mask area (e.g. adjacent to an outer edge of the mask area). Further, in case of the control type B, the ejection position is set as a position posterior to the ejection position candidate along the secondary scanning direction and outside of the mask area (e.g. adjacent to an outer edge of the mask area). Furthermore, in case of the control type C, for example, the ejection position is set as the same position on the next page.

In the aforementioned manner, the ejection position of the target nozzle of the preliminary ink ejection is determined.

Meanwhile, the image processing unit 82 generates a print image corresponding to the received print request.

Subsequently, the control unit 81 controls the image outputting unit 71 and thereby prints the print image on a print sheet and performs the preliminary ink ejection at the determined ejection position (at the determined ejection timing) as mentioned, for the target nozzle of the preliminary ink ejection.

As mentioned, in the aforementioned embodiment, the print engine 10*a* ejects an ink droplet from a nozzle and thereby prints an image to be printed on a print sheet. When performing on-sheet preliminary ink ejection of the print engine 10*a*, the control unit 81 (a) determines a nozzle that performs the on-sheet preliminary ink ejection, (b) randomly selects on the print sheet an ejection position candidate of an ink droplet ejected from the determined nozzle, (c) determines whether the selected ejection position candidate is included by a mask area that includes a postprocessing object, (d1) if the selected ejection position candidate is not included by the mask area, sets as the selected ejection position candidate an ejection position of an ink droplet ejected from the determined nozzle, and (d2) if the selected ejection position candidate is included by the mask area, does not set as the selected ejection position candidate an ejection position of an ink droplet ejected from the determined nozzle and sets an ejection position of an ink droplet ejected from the determined nozzle outside of the mask area.

Consequently, the on-sheet preliminary ink ejection does not result in the deterioration of the postprocessing object, and therefore, precision decrease is restrained of a postprocess using the postprocessing object.

It should be understood that various changes and modifications to the embodiments described herein will be apparent to those skilled in the art. Such changes and modifications may be made without departing from the spirit and scope of the present subject matter and without diminishing its intended advantages. It is therefore intended that such changes and modifications be covered by the appended claims.

What is claimed is:

1. An image forming apparatus, comprising:

a print engine configured to eject an ink droplet from a nozzle and thereby print an image to be printed on a print sheet; and a control unit configured to control the print engine;

wherein when performing on-sheet preliminary ink ejection, the control unit (a) determines a nozzle that performs the on-sheet preliminary ink ejection, (b) randomly selects on the print sheet an ejection position candidate of an ink droplet ejected from the determined nozzle, (c) determines whether the selected ejection position candidate is included by a mask area that includes a postprocessing object, (d1) if the selected ejection position candidate is not included by the mask area, sets as the selected ejection position candidate an ejection position of an ink droplet ejected from the determined nozzle, and (d2) if the selected ejection position candidate is included by the mask area, does not set as the selected ejection position candidate an ejection position of an ink droplet ejected from the determined nozzle and sets an ejection position of an ink droplet ejected from the determined nozzle outside of the mask area.

2. The image forming apparatus according to claim 1, wherein the postprocessing object is either a trim mark or a color patch.

3. The image forming apparatus according to claim 1, wherein if the selected ejection position candidate is included by the mask area, the control unit makes ejection timing of the ink droplet ejected from the determined nozzle earlier and thereby sets the ejection position of the ink droplet ejected from the determined nozzle outside of the mask area.

4. The image forming apparatus according to claim 1, wherein if the selected ejection position candidate is included by the mask area, the control unit delays ejection timing of the ink droplet ejected from the determined nozzle and thereby sets the ejection position of the ink droplet ejected from the determined nozzle outside of the mask area.

5. The image forming apparatus according to claim 1, wherein if the selected ejection position candidate is included by the mask area, the control unit performs ejection of the ink droplet ejected from the determined nozzle on a subsequent print sheet to the print sheet on which the mask area is set.

6. The image forming apparatus according to claim 1, wherein the control unit selects a control type from a predetermined three control types in accordance with user setting, and if the selected ejection position candidate is included by the mask area, performs the on-sheet preliminary ink ejection of the determined nozzle in accordance with the selected control type;

a first control type among the three control types makes ejection timing of the ink droplet ejected from the determined nozzle earlier and thereby sets the ejection position of the ink droplet ejected from the determined nozzle outside of the mask area;

a second control type among the three control types delays ejection timing of the ink droplet ejected from the determined nozzle and thereby sets the ejection position of the ink droplet ejected from the determined nozzle outside of the mask area; and a third control type among the three control types performs ejection of the ink droplet ejected from the determined nozzle on a subsequent print sheet to the print sheet on which the mask area is set.

7. The image forming apparatus according to claim 1, wherein the mask area includes (a) the postprocessing object and (b) a margin set with a predetermined width on an outer edge of the postprocessing object; and the width of the margin is enabled to be set by a user.

* * * * *